United States Patent [19]

Cottenceau et al.

[11] Patent Number: 4,890,451

[45] Date of Patent: Jan. 2, 1990

[54] METHOD FOR LOOSENING AND UNRAVELLING A TEXTILE YARN

[75] Inventors: Rémi Cottenceau, Viry, France; Erwin Zurcher, Le Lignon, Switzerland

[73] Assignee: Mesdan S.p.A., Salo, Italy

[21] Appl. No.: 301,345

[22] Filed: Jan. 25, 1989

[30] Foreign Application Priority Data

Feb. 20, 1987 [CH] Switzerland ..... 653/87

[51] Int. Cl.[4] ..... D01H 15/00

[52] U.S. Cl. ..... 57/22

[58] Field of Search ..... 57/22, 261, 263

[56] References Cited

U.S. PATENT DOCUMENTS

| | | | |
|---|---|---|---|
| 4,170,103 | 10/1979 | Norris et al. | 57/22 X |
| 4,229,935 | 10/1980 | Wain | 57/22 |
| 4,244,169 | 1/1981 | Ligones et al. | 57/22 |
| 4,356,688 | 11/1982 | Zurcher et al. | 57/22 |
| 4,406,115 | 9/1983 | Negaty-Hindi et al. | 57/22 |
| 4,492,076 | 1/1985 | Romic et al. | 57/22 |
| 4,528,808 | 7/1985 | Luz | 57/22 |
| 4,637,205 | 1/1987 | Badiali et al. | 57/22 |
| 4,693,067 | 9/1987 | Locatelli | 57/22 |

FOREIGN PATENT DOCUMENTS

| | | |
|---|---|---|
| 0053093 | 10/1981 | European Pat. Off. . |
| 2939481 | 10/1985 | Fed. Rep. of Germany . |
| 2954425 | 10/1985 | Fed. Rep. of Germany . |

*Primary Examiner*—Donald Watkins

*Attorney, Agent, or Firm*—Cushman, Darby & Cushman

[57] ABSTRACT

The yarn to be loosened is guided by slots (7;8); it is held on one side thereof and it is cut on the other side. Air is injected by a nozzle (13) for driving the cut end of the yarn into a channel (1), between the bottom (11) of this channel and the longitudinal edge of the adjacent flexible leaf (10) which is vibrated simultaneously at several hundreds of Hz. The air can escape sidewise through a longitudinal opening (4) of channel (1) and entrains the yarn from one side to the other side of the leaf (10) and imparts to this yarn alternatively inverted twists. A further action of the leaf (10) is to pulse the air in the channel and therefore to subject the yarn to intermittently applied pulls.

6 Claims, 1 Drawing Sheet

METHOD FOR LOOSENING AND UNRAVELLING A TEXTILE YARN

This is a division of application Ser. No. 07/154,039, filed Feb. 9, 1988 now U.S. Pat. No. 4,829,759.

FIELD OF THE INVENTION

The present invention relates to a universal method for loosening and unravelling a textile yarn by putting the free end of this yarn in a duct having a vibrating blade driven by a stream of air and by holding it upstream to this stream.

BACKGROUND OF THE INVENTION

Knotless splicing systems tend to progressively replace the classical knotters in all fields of textile. The first condition to be met for obtaining a join in a yarn which is strong and not visible at the same time, is to properly loosen and unravel the ends of the yarn to be joined. Theoretically, since the yarn results from a degree of twisting of the fibers, it is sufficient to untwist the yarn while holding it firmly and to remove the fibers which get loose from the section where the yarn is held. Although this technique is quite valid for yarns obtained by spinning on a ring spinning frame, it does no longer operate in the case of yarn produced by the "open-end" technique or for two-plyed yarns. Furthermore, it should be remembered that yarns can be obtained with a right-hand or a left-hand twist. This explains why it is difficult to loosen and unravel certain types of yarn and, practically, no apparatus or method exists which can loosen all types of yarn.

Among the proposed solutions, one should particularly distinguish those relying on mechanical effects from those relying on air dynamics. Such solutions are disclosed in DE-C2-2,954,426 and in DE-C2-2,939,481. In both documents, the yarn is introduced into a duct in which a tangential air flow is provided to untwist the yarn and separate the loosened fibers from each other, i.e. to effect unravelling.

As previously mentioned, this untwisting mode is only valid, at best, for yarns achieved according to the classic ring spinning frame technique but is ineffective for other types of yarn. Moreover, in practising the methods of these documents, the twisting rotation of the yarn, in S or Z, must be known, so that the air-dynamic action is applied to the yarn in a direction opposite to that of untwist. A particular problem is therfore present in the case of two plyed yarns which can consist of S-twisted yarns which are thereafter Z-twisted, or the converse. This is the reason why a method has been proposed in EP-A1 0 053 093 which consists of reducing the rubbing forces existing between the fibers by subjecting them to vibrations and by simultaneously exerting an axial stress for separating the fibers after loosening the yarn. It has been shown that this technique makes it possible to loosen and unravel yarns known to be difficult, such as "open-end" yarns and two plyed yarns.

It has been shown that the vibrating or pulsed member contributes to improving continuous methods each time the yarn under consideration has fibers which are not parallel, for instance in the case of two plyed yarns or open-end yarns. Indeed, when some of the fibers are not parallel, they can tangle up and a periodically interrupted action is then more efficient than a static action which, in fact, promotes tangling up. This is the reasn why better results are obtained with a vibrating member present in the air flow duct in which the yarn to be loosened has been introduced.

SUMMARY OF THE INVENTION

The object of the present invention is to make an improvement to the untwisting method in which a vibrating member is used in order to further improve its efficiency. In fact, until now the vibrating member was simply used as a striking element acting on the yarn and simultaneously providing turbulent effects in the flow. The presently proposed solution seeks a better control of the air-dynamic effects applied to the yarn.

For doing this, an object of this invention relates first to a universal method for loosening and unravelling a yarn and a device for carrying out this method.

As will be explained in more detail hereafter, it has been demonstrated, with a high-speed camera as well as with a stroboscope, that the contribution of the vibrating leaf in this method is basically different from that in the foregoing document. This modification essentially results from the presence of a longitudinal opening in the duct which opens sidewise thereto, which considerably modifies the mode of flow of the air and the mutual behavior of the yarn and the vibrating leaf in this airflow.

BRIEF DESCRIPTION OF THE DRAWING

The accompanying drawing illustrates very schematically and as an example an embodiment of a device for carrying out the method according to the invention.

DETAILED DESCRIPTION OF THE INVENTION

Figure 1:
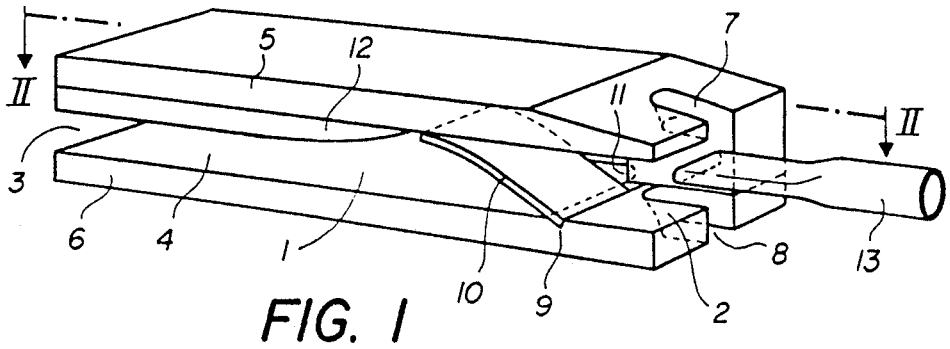
FIG. 1 is a perspective enlarged view of this device.
Figure 2:
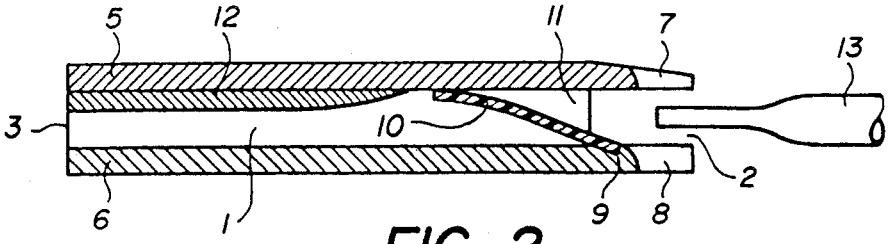
FIG. 2 is a cross-sectional view along line II-II of FIG. 1.

The device illustrated in FIGS. 1 and 2 includes a duct 1 with a rectangular cross-section and with both ends 2 and 3 opened and having a longitudinal side opening 4 extending along its full length which corresponds to a side of the rectangular section of the duct 1. Both walls 5 and 6 which form the lateral faces of duct 1 include two slots 7 and 8, respectively, in facing relation to each other, for positioning the yarn to be loosened. One of the walls 5 and 6 is provided with a recess 9 which forms two faces at right angle, one of which is, in this example, at an angle of 20° with the wall of duct 1. This recess 9 enables positioning of a flexible leaf 10 which extends across duct 1. The material selected for making this leaf can be, for example a neoprene sheet 70 shore which has a good resistance to wear.

The bottom of duct 1 is provided with a clearance 11 which extends along most of the duct length and whose front end approximately faces the site where the flexible leaf 10 protrudes from the wall in which it is fastened. This clearance 11 is about 2 mm deep in this example and the distance between its bottom and the adjacent parallel edge of the leaf 10 is 3 mm.

As shown on FIG. 2, a leaf 12 is fastened against wall 5 of duct 1 and extends from the free end of the leaf 10 to the downstream end 3 of duct 1. This leaf is designed to reduce the duct cross-section to compensate for the air velocity drop and to increase as much as possible the force applied to the yarn. A nozzle 13 slightly penetrates the upstream end of duct 1. It is connected to a pressurized air supply (not represented).

It follows, if one considers the great number of textile fibers to be loosened and the various characteristics thereof discussed above, as well as the problems related to process analysis in view of the high frequencies involved (1000 Hz for the vibration of the flexible leaf 10), the tuning up of such a method and of the device for its inplementation is based in part on systematic experiments. Hence, the aforedisclosed device results from a basic concept which has advanced until good results were obtained.

Once acceptable results were obtained, observations were made simultaneously with a high-speed movie camera and a strobe-light, in order to better understand the reasons enabling to loosen and unravel yarns of different kinds with constant results. These observations facilitated the description of the airdynamical behavior of the yarn and the leaf 10 in duct 1 as illustrated in FIGS. 3 to 7.

When a yarn is to be loosened and unravelled, it passes across slots 7 and 8 and nozzle 13 is set into the upstream end 2 of duct 1. The yarn is cut to the desired length on one side of the duct with a knife (not shown) while it is retained at the other side of this channel 1. Air is then supplied under pressure to the nozzle 13 and the ejected air's first effect is to introduce the yarn into duct 1. Due to slots 7 and 8, the yarn sets itself between the bottom 11 of duct 11 and the longitudinal adjacent edge of the flexible leaf 10. Simultaneously, this leaf starts to vibrate very fast at a frequency of about 1000 Hz. These pulsations of the leaf between two opposite walls 5 and 6 of the duct 1 result in a displacement of the yarn faced opposite to that of the leaf. Because of the presence of the side opening 4 of duct 1, part of the air can escape sidewise from this duct. Because of this, the yarn can return, after turning around the flexible leaf 10 (FIGS. 4 and 6), below (FIG. 5) and above (FIG. 7) this leaf, respectively. In the figures, the arrows $F_1$, $F_2$ show the respective displacements of the leaf 10 and the yarn. As indicated, during a complete cycle (FIGS. 3 to 7) the yarn is subjected to two oppositely directed rotations with regard to its longitudinal axis. These rotations correspond to twising and untwisting the fibers which explains why the method suits all kinds of yarns.

Figure 3:
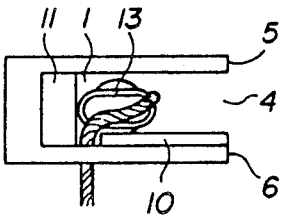
FIGS. 3 to 7 are views, taken from the downstream end of the device relative to the air flow, showing various phases of the method.
Figure 4:
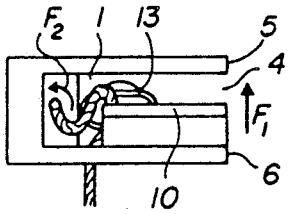
Figure 5:
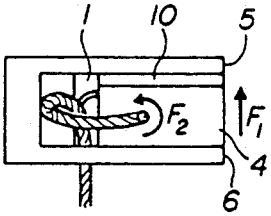
Figure 6:
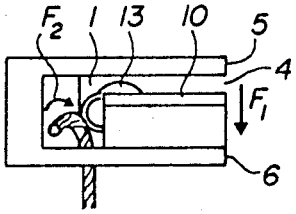
Figure 7:
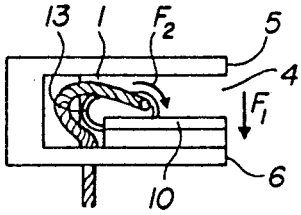

In addition to the displacement of this yarn, the displacement of the leaf 10 acts on the flow of air. Indeed, as can be seen, when the leaf 10 beats from one wall 5 to the other 6 of duct 1, and vice-versa, it periodically opens the way to the air exiting from the nozzle (FIG. 3) and periodically closes duct 1 and deflects this air sidewise (FIG. 5). Since, in the position illustrated in FIG. 5, the free end of the yarn is below leaf 10, the pull applied thereto decreases first and then increases (FIGS. 7 and 3). Consequently, the yarn is subjected, synchronously with the successive twists and untwists, to pulling pulses which alternate with release. The pulsed nature of the twist-untwist motion and the pulling pulses doubtlessly explain why the aforedisclosed process is efficient. As can be seen, the presence of the longitudinal opening 4 which extends sidewise to the yarn allows the yarn to simultaneously move, not only from one side to the other of the duct, but also above and below the leaf and also allows the pulling effect on the yarn to be modulated, the air, in the case of FIG. 5, being deflected sidewise toward the outside through the longitudinal opening 4 of duct 1.

It is useful to provide a few data relative to some critical dimensions of the device, these data allowing to correctly operate the method.

Duct 1 should not be too short, otherwise the fibers which extend beyond its downstream end may mingle to give small knots and thus prevent the fibers to open to a tow as desired. Tests have shown that the length of this duct should be between about 30 and 35 mm. The length of the flexible leaf 10 is about ⅓ of that of the channel. One important feature is the distance between the longitudinal edge of flexible leaf 10 adjacent to the bottom of the clearance 11 and this bottom which simultaneously constitutes the bottom of channel 1. In the disclosed example, this distance is 3 mm whereas it is at 0.5–1 mm from the undrilled portion of the bottom, the width of the leaf being 5 mm. The nozzle 13 has an internal diameter of 2 mm. Preferably, as represented, the nozzle is slightly deformed to provide an elongated opening 1 mm wide. This variant has provided excellent results when the greater axis of the ovalized opening is in the same direction as the height of the rectangular cross-section of duct 1. It appears that the laminar flow parameter of the air stream from this nozzle is enhanced.

The period of time of air injection to loosen and unravel varies with different fiber types. For short fiber cotton yarn, this time is about 0.15 sec., even 0.10 sec. For yarns of the wool type, with long fibers, the injection time appears to be in direct function to the nature of the yarn (classical "open-end") and of the denier thereof and varies between 0.15 and 0.30 sec.

Two plyed cotton yarn gets loose relatively rapidly with an injection time of 0.15 sec. A certain risk exists that small knots form at the end if the time is incorrect. Two plyed woollen yarns are more difficult to loosen and unravel. If the air injection duration is set correctly, the risk of knot formation is very small. This duration varies from 0.15 to 0.30 sec.

Instead of varying the time of air injection, it is also possible to vary the rate of air injected by the nozzle during a same period of time. This air flow variation also allows to adapt the method to different kinds of yarns. For example, in the case of cotton and two plyed yarns and with a round opening nozzle of 1.5 mm diameter, the rates can be 75 l/min and 140 l/min, respectively.

Regarding the size of leaf 12 applied against a wall of the duct downstream of the flexible leaf 10, its purpose is to define the thickness 13 to be such that, with an oval nozzle 13, the ratio between the width of the cross-section of this nozzle and the thickness 13 be approximatively 1:2.

Resistance trials on flexible leafs were achieved. They showed that a leaf made of neoprene 70 shore withstands more than 400,000 operations, when using a 1.5 mm diameter nozzle and an air flow rate of 105 l/min, each operation lasting 0.18 sec.

We claim:

1. A method for loosening and unravelling a textile yarn by putting the free end of the yarn in a flowing stream of air, and by holding the yarn upstream of this flow, characterized in subjecting the yarn to a plurality of alternate twist and untwist actions at a frequency of several hecto-Hz and modulating said air stream to generate, at the free end of the yarn, a pulsed regime of pulls in synchronization with the frequency of said alternate twist and untwist action.

2. Method according to claim 1, characterized in subjecting the yarn to said alternate twist and untwist action for a period comprised between 0.10 and 0.30 sec., depending on the nature of the yarn.

3. A method for loosening and unravelling a textile yarn to be spliced, said method comprising the steps of:

blowing the yarn into a slotted duct having a flexible leaf positioned therein;

vibrating the flexible leaf by blowing air along the slotted duct, thereby modulating the air flow downstream from the flexible leaf;

dissolving the twist of the yarn by the combined forces of the modulated air and the vibrating leaf contacting the yarn.

4. A method as in claim 3 wherein in said vibrating step the flexible leaf vibrates up to 1000 Hz.

5. A method as in claim 3 wherein in said dissolving step the yarn is subjected to alternate twist and untwist action.

6. A method as in claim 5 wherein the period of the alternate twist and untwist action ranges between 0.10 and 0.30 seconds.

* * * * *